US008579458B2

(12) United States Patent
Okamura et al.

(10) Patent No.: US 8,579,458 B2
(45) Date of Patent: Nov. 12, 2013

(54) FITTING MEMBER, LEAF SPRING AND LIGHTING APPARATUS

(75) Inventors: Noritaka Okamura, Osaka (JP); Yoshiyuki Kitamura, Osaka (JP); Hiroyuki Yamamoto, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 397 days.

(21) Appl. No.: 12/921,080

(22) PCT Filed: Feb. 23, 2009

(86) PCT No.: PCT/JP2009/053137
§ 371 (c)(1),
(2), (4) Date: Sep. 3, 2010

(87) PCT Pub. No.: WO2009/110336
PCT Pub. Date: Sep. 11, 2009

(65) Prior Publication Data

US 2011/0002115 A1 Jan. 6, 2011

(30) Foreign Application Priority Data

Mar. 7, 2008 (JP) ..... 2008-058504

(51) Int. Cl.
*F21V 21/00* (2006.01)

(52) U.S. Cl.
USPC ..... 362/150; 362/148; 362/365

(58) Field of Classification Search
USPC ..... 362/148, 150, 147, 217.12, 365, 368
See application file for complete search history.

(56) References Cited

U.S. PATENT DOCUMENTS

| | | | | | |
|---|---|---|---|---|---|
| 3,037,110 | A * | 5/1962 | Williams | ..... | 362/147 |
| 5,574,600 | A * | 11/1996 | Agro | ..... | 359/818 |
| 5,609,414 | A * | 3/1997 | Caluori | ..... | 362/366 |
| 5,725,302 | A * | 3/1998 | Sirkin | ..... | 362/365 |
| 6,174,076 | B1 * | 1/2001 | Petrakis et al. | ..... | 362/365 |
| 7,909,487 | B1 * | 3/2011 | Venetucci et al. | ..... | 362/364 |

FOREIGN PATENT DOCUMENTS

| | | | |
|---|---|---|---|
| JP | 6-5029 | U | 1/1994 |
| JP | 2000-123627 | A | 4/2000 |
| JP | 2005-276745 | A | 10/2005 |
| JP | 2006-185602 | A | 7/2006 |
| JP | 2007-128789 | A | 5/2007 |

OTHER PUBLICATIONS

International Search Report, dated Apr. 21, 2009 issued in PCT/JP2009/053137.

* cited by examiner

*Primary Examiner* — Laura Tso
(74) *Attorney, Agent, or Firm* — Birch, Stewart, Kolasch & Birch, LLP

(57) ABSTRACT

A V-shaped leaf spring is provided, at one side of the leaf spring, with a plurality of pressing parts curved convexly toward the other side thereof and arc-shaped in cross section along a longitudinal direction of the leaf spring. The leaf spring is appropriately attached to a lighting apparatus main body so that a region of the leaf spring at a bent part thereof is located downward. Thus, upon installation of the lighting apparatus main body into an attachment hole provided in a ceiling, either one of the plurality of pressing parts abuts against the ceiling having different thicknesses from above, and a sufficient downward pressing force can be exerted on the ceiling having different thicknesses, thereby allowing the component to be fixed to the ceiling with a sufficient holding force.

22 Claims, 15 Drawing Sheets

FITTING MEMBER, LEAF SPRING AND LIGHTING APPARATUS

This application is the national phase under 35 U.S.C. §371 of PCT International Application No. PCT/JP2009/053137 which has an International filing date of Feb. 23, 2009 and designated the United States of America.

BACKGROUND

1. Technical Field

The present invention relates to: a fitting member and a leaf spring by which an apparatus main body, installed into an attachment hole opened in a ceiling, is fitted to the ceiling; and a lighting apparatus including the fitting member or leaf spring.

2. Description of Related Art

A lighting apparatus installed into an attachment hole opened in a ceiling, i.e., a so-called "downlight", is inserted into the attachment hole in the ceiling from below, and is fixed to the ceiling by a fixture provided at a main body of the lighting apparatus. This lighting apparatus is formed so that a V-shaped leaf spring is generally used as a fixture, and the ceiling is pressed by an urging force produced in response to elastic deformation of the leaf spring, thereby fixing the lighting apparatus to the ceiling (see Japanese Patent Application Laid-Open No. 2007-128789, for example).

The lighting apparatus disclosed in Japanese Patent Application Laid-Open No. 2007-128789 includes: an outer frame having an approximately cylindrical shape or box-like shape and installed into an attachment hole provided in a ceiling; and a lighting apparatus main body hooked to inside of the outer frame by a hook member provided at the outer frame. This lighting apparatus is formed so that upper and lower surfaces of the ceiling are sandwiched between a fixture provided at an outer peripheral wall of the outer frame and a flange part provided at a lower end of the outer frame, thus fixing the lighting apparatus main body. The fixture is a V-shaped leaf spring and has, at its one side, an attachment part attached to the outer frame and has, at its other side, an arc-shaped pressing part curved convexly toward the one side. Upon insertion of the outer frame into the attachment hole provided in the ceiling, the pressing part of the fixture is pressed against an upper edge region of the attachment hole from obliquely above by an urging force produced in response to elastic deformation of the fixture, so that a downward force acts on the ceiling, the outer frame receives an upward force from the fixture in reaction to this, and an upper surface of the flange part is pressed and fixed to the lower surface of the ceiling, resulting in fixation of the lighting apparatus to the ceiling.

SUMMARY

Actually, in general, a diameter of an attachment hole provided in a ceiling falls within the range of 50 mm to 300 mm, and a ceiling thickness falls within the range of 5 mm to 25 mm. Outer dimensions of a lighting apparatus are decided in accordance with the diameter of the attachment hole so as to enable placement of a fitting member such as a leaf spring, and so as to allow an outer peripheral wall of a lighting apparatus main body and a peripheral face of the attachment hole to be spaced apart at an appropriate distance.

In the lighting apparatus including the leaf spring having only one arc-shaped pressing part as disclosed in Japanese Patent Application Laid-Open No. 2007-128789, an appropriate pressing force is exerted on a ceiling when the ceiling has a given thickness, thereby enabling fixation of the lighting apparatus thereto. However, when the lighting apparatus is installed on a ceiling having a thickness larger than the given thickness, an angle formed by the pressing part with respect to the upper surface of the ceiling is increased, and a downward pressing force becomes insufficient, which might make it impossible to sufficiently hold the lighting apparatus. Furthermore, when a downward force is exerted on the lighting apparatus and this force is thereafter released, the lighting apparatus might not be able to return to its original position. To cope with these problems, the use of leaf springs having different shapes in accordance with thicknesses of ceilings may be conceivable, but the use of such leaf springs is unfavorable in terms of workability of installation of the lighting apparatus, production efficiency of the leaf springs, etc.

The present invention has been made in view of the above-described circumstances, and its object is to provide: a fitting member and a leaf spring which exert sufficient pressing forces on ceilings having different thicknesses; and a lighting apparatus including the fitting member or leaf spring.

A fitting member of the present invention is a fitting member used to fit an apparatus such as a lighting apparatus to a fit part, such as a ceiling, having different thicknesses, characterized in that the fitting member includes a plurality of pressing parts adapting to the fit part having different thicknesses.

In the present invention, when an apparatus such as a lighting apparatus is fitted to a fit part such as a ceiling, any one of the plurality of pressing parts is abutted and pressed against the fit part having different thicknesses, and a sufficient pressing force can be exerted on the fit part having different thicknesses, thereby allowing the lighting apparatus or the like to be fitted to the fit part such as a ceiling with a sufficient holding force.

The fitting member of the present invention is further characterized in that the pressing parts are arc-shaped.

In the present invention, any one of the plurality of pressing parts is abutted and pressed against the fit part such as a ceiling from above, and a sufficient downward pressing force can be exerted on a ceiling having different thicknesses, thereby allowing the lighting apparatus or the like to be fixed to the fit part such as a ceiling with a sufficient holding force.

The fitting member of the present invention is further characterized in that the pressing part is pressed to the fit part by a force including a force perpendicular thereto.

In the present invention, any one of the plurality of pressing parts is abutted and pressed against the fit part such as a ceiling from above, and a sufficient downward pressing force can be exerted on a ceiling having different thicknesses, thereby allowing the lighting apparatus or the like to be fixed to the fit part such as a ceiling with a sufficient holding force.

The fitting member of the present invention is further characterized in that the plurality of pressing parts are curved with different radii of curvature.

In the present invention, the plurality of pressing parts are curved with different radii of curvature, and are thus adaptable to the fit part having different thicknesses.

The fitting member of the present invention is further characterized in that the fitting member includes a bent part, and one of the plurality of pressing parts, located further away from the bent part, has a larger radius of curvature.

In the present invention, the radii of curvature of the pressing parts are increased gradually from the one located close to the bent part, thereby allowing the fitting member to be adaptable to a ceiling serving as the fit part having a wide range of thicknesses.

The fitting member of the present invention is further characterized in that the plurality of pressing parts are continuously provided, and a connection between the plurality of pressing parts is located on the side of the pressing part from a straight line formed by connecting end portions of the plurality of pressing parts.

In the present invention, even when the fitting member includes a plurality of pressing parts, the connection between the pressing parts will not come into contact with the fit part, and therefore, a reduction in the pressing force, caused by the contact, can be prevented.

The fitting member of the present invention is further characterized in that the fitting member is a leaf spring.

In the present invention, it is possible to form the leaf spring that is capable of exerting a sufficient pressing force on the fit part, such as a ceiling, having different thicknesses, and that allows a lighting apparatus or the like to be fitted to the fit part such as a ceiling with a sufficient holding force.

A leaf spring of the present invention is a V-shaped leaf spring, characterized in that the leaf spring includes a plurality of pressing parts provided at one side thereof, curved convexly toward the other side thereof, and arc-shaped in cross section along a longitudinal direction of the leaf spring.

In the present invention, the V-shaped leaf spring is provided at its one side with a plurality of pressing parts curved convexly toward the other side thereof and arc-shaped in cross section along the longitudinal direction of the leaf spring, and the leaf spring is appropriately attached to a lighting apparatus main body so that a region of the leaf spring at a bent part thereof is located downward, for example. Thus, upon installation of the lighting apparatus main body into an attachment hole provided in a ceiling, any one of the plurality of pressing parts abuts against the ceiling having different thicknesses from above, and a sufficient downward pressing force can be exerted on the ceiling having different thicknesses, thereby allowing the lighting apparatus main body to be fixed to the ceiling with a sufficient holding force.

A lighting apparatus of the present invention is characterized in that the apparatus includes a lighting apparatus main body fitted by the fitting member according to the foregoing inventions.

In the present invention, it is possible to form the lighting apparatus that exerts a sufficient pressing force on a fit part, such as a ceiling, having different thicknesses, and that can be fitted thereto with a sufficient holding force.

The lighting apparatus of the present invention is characterized in that the fitting member is located at a position that does not impede a flow of air coming into a heat radiation part of the lighting apparatus.

In the present invention, it is possible to attach the fitting member to the lighting apparatus without reducing the heat radiation efficiency of the heat radiation part of the lighting apparatus.

The lighting apparatus of the present invention is characterized in that the lighting apparatus is fitted to the fit part by sandwiching the fit part between the fitting member and a part of the lighting apparatus abutted against the fit part.

In the present invention, the lighting apparatus can be fitted to the fit part such as a ceiling with stability.

A lighting apparatus according to the present invention includes: a lighting apparatus main body to be installed into an attachment hole opened in a ceiling; and a V-shaped leaf spring to be interposed between the lighting apparatus main body and the attachment hole with a region of the leaf spring at a bent part thereof located downward, and the lighting apparatus main body is fixed to the ceiling by an urging force produced in response to elastic deformation of the leaf spring, the lighting apparatus characterized in that the leaf spring is the leaf spring according to the foregoing inventions, which includes a plurality of pressing parts at one side thereof, the leaf spring is attached at its other side to the lighting apparatus main body, and upon installation of the lighting apparatus main body into the attachment hole, any one of the plurality of pressing parts abuts against an upper edge region of the attachment hole from above.

In the present invention, upon installation of the lighting apparatus main body into the attachment hole in a ceiling, any one of the plurality of pressing parts of the leaf spring attached to the lighting apparatus main body abuts against the upper edge region of the attachment hole from above, and therefore, a sufficient downward pressing force can be exerted on the ceiling having different thicknesses, thereby allowing the lighting apparatus to be fixed to the ceiling with a sufficient holding force.

According to the present invention, a fitting member or leaf spring having a plurality of pressing parts is capable of exerting a sufficient downward pressing force on a ceiling having different thicknesses, thereby allowing a lighting apparatus to be fixed to the ceiling with a sufficient holding force.

The above and further objects and features will move fully be apparent from the following detailed description with accompanying drawings.

DETAILED DESCRIPTION

Hereinafter, the present invention will be described in detail with reference to the drawings illustrating embodiments thereof. Further, in the description of the embodiments, a leaf spring will be illustrated as a fitting member, and an apparatus to be fitted, via a leaf spring, to a ceiling serving as a fit part will be described as a lighting apparatus. Note that the lighting apparatus is a so-called "downlight". Furthermore, in the following description, "downward" means a vertical downward direction perpendicular to an installation plane of a ceiling serving as a fit part.

Embodiment 1

Figure 1:
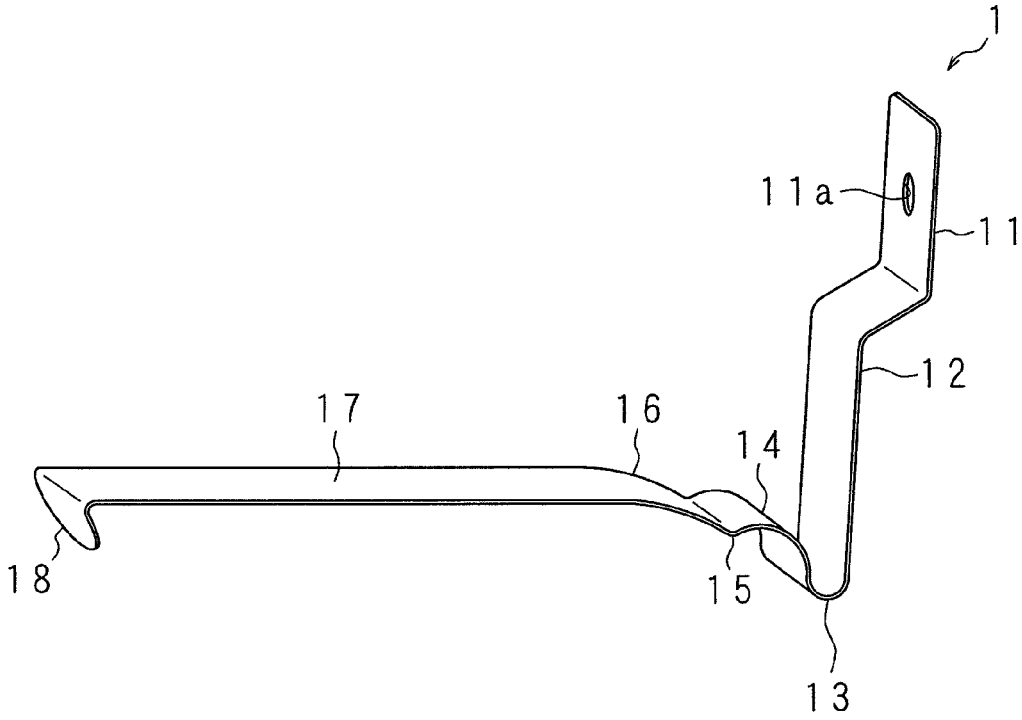
FIG. 1 is an external perspective view of a leaf spring according to Embodiment 1 of the present invention.
Figure 2:
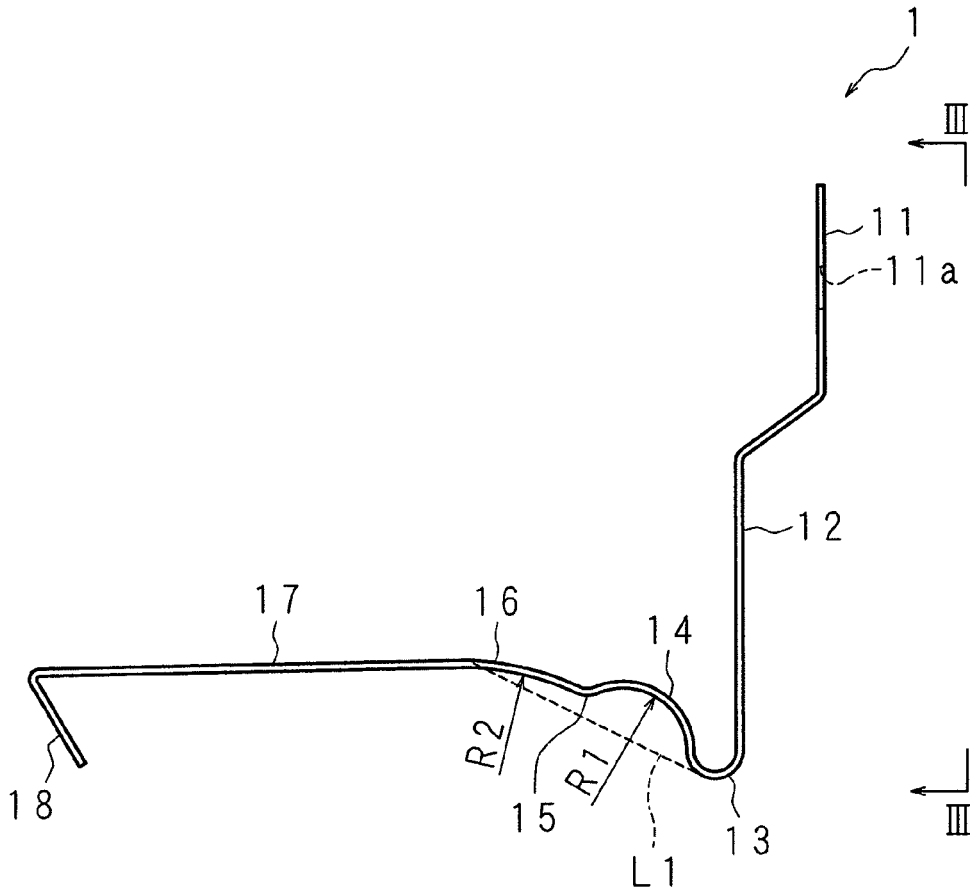
FIG. 2 is a schematic front view of the leaf spring.
Figure 3:
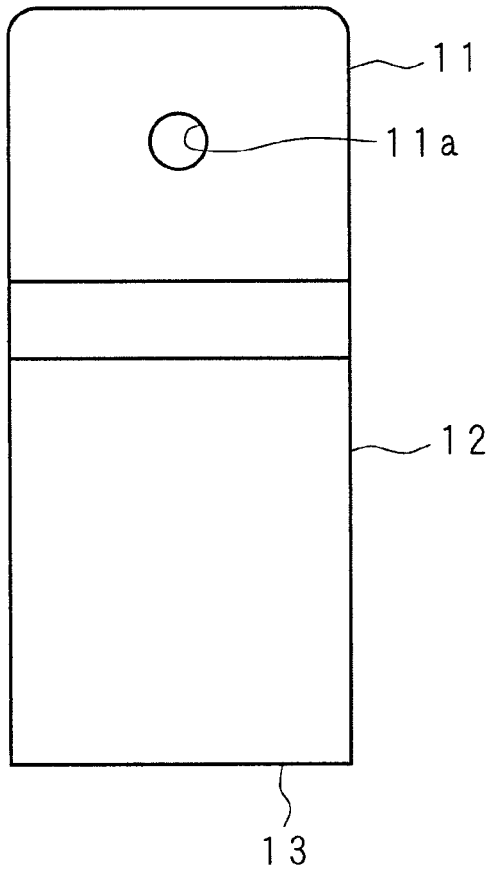
FIG. 3 is a schematic side view of the leaf spring as viewed in a direction indicated by arrows III-III of FIG. 2.

FIG. 1 is an external perspective view of a leaf spring according to Embodiment 1 of the present invention. FIG. 2 is a schematic front view of the leaf spring. FIG. 3 is a schematic side view of the leaf spring as viewed in a direction indicated by arrows of FIG. 2.

An elongated rectangular plate made of metal such as stainless steel is bent, thereby forming a leaf spring 1 into a V shape as illustrated in FIG. 2. The leaf spring 1 is provided at its one end with a rectangular plate-like attachment part 11, and a through hole 11*a* is formed at a center of the attachment part 11.

To the attachment part 11, an extended part 12 is extended at an angle with respect to the attachment part 11, and is then extended from the extended end in parallel with the attachment part and in a direction away from the attachment part. The extended part 12 is connected to a bent part 13 curved at about 180° with a small radius of curvature.

The leaf spring 1 is provided at its other side with a first pressing part 14 convexly curved toward the attachment part 11 and arc-shaped in cross-section along a longitudinal direction of the leaf spring 1, with the bent part 13 located between one and other sides thereof. The first pressing part 14 is connected to a convex part 15 curved in a direction opposite to the curved direction of the first pressing part 14. The convex part 15 is connected to a second pressing part 16 convexly curved in a direction identical to the curved direction of the first pressing part 14 and arc-shaped in cross-section along the longitudinal direction of the leaf spring 1.

Further, the first pressing part 14 and the second pressing part 16 are each formed into an arc shape; thus, when a lighting apparatus is attached to an installation plane of a fit part such as a ceiling, either the first pressing part 14 or the second pressing part 16 can be pressed against a surface of an attachment hole, and can also be pressed in a direction perpendicular to the installation plane. In this respect, detailed description will be made in the description of an after-mentioned embodiment in which a lighting apparatus is installed on a ceiling.

Curvatures of the first pressing part 14 and the second pressing part 16 have different radii of curvature, and a radius of curvature R2 of the second pressing part 16 is larger than a radius of curvature R1 of the first pressing part 14 (R1<R2). In the present embodiment, on the assumption that a thickness of a ceiling on which an after-mentioned lighting apparatus is to be installed would fall within the range of 6 mm to 9 mm and the range of 20 mm to 25 mm, the radius of curvature R1 of the first pressing part 14 is set at 6 mm, and the radius of curvature R2 of the second pressing part 16 is set at 23 mm. The radii of curvature R1 and R2 of the first pressing part 14 and the second pressing part 16 are decided in accordance with a thickness of a ceiling so that when a lighting apparatus is installed on the ceiling, only either the first pressing part 14 or the second pressing part 16 abuts against the ceiling from above.

Moreover, since the second pressing part 16, located away from the bent part 13, has a radius of curvature larger than that of the first pressing part 14 located close to the bent part 13 (i.e., R1<R2), the leaf spring is adaptable to a wide range of ceiling thicknesses. In other words, if the radius of curvature of the pressing part located close to the bent part is larger, the leaf spring is adaptable to a ceiling having a large thickness (in the range of 20 mm to 25 mm, for example) and a ceiling having a larger thickness, but is not adaptable to a ceiling having a small thickness (in the range of 6 mm to 9 mm, for example). Accordingly, the radii of curvature of the pressing parts are increased gradually from the one located close to the bent part 13, thereby allowing the leaf spring to be adaptable to ceilings having a wide range of thicknesses.

Note that the first pressing part 14 and the second pressing part 16 do not necessarily have to have different radii of curvature. By providing a plurality of arc-shaped pressing parts, a lighting apparatus can be adaptively fitted to the fit parts having different thicknesses.

Besides, the convex part 15, serving as a connection between the first pressing part 14 and the second pressing part 16, is preferably designed so as to be located on the side of the first pressing part 14 and the second pressing part 16 from a straight line L1 (indicated by the broken line in FIG. 2) formed by connecting an end portion of the first pressing part 14 with that of the second pressing part 16. Even when a lighting apparatus is adaptively attached to a ceiling having a large thickness (in the range of 20 mm to 25 mm, for example) with the second pressing part 16 pressed thereto, the convex part 15 will not come into contact with a surface of an attachment hole in the ceiling, and therefore, a reduction in the pressing force, caused by the contact, can be prevented.

The second pressing part 16 is connected to a rectangular plate-like arm part 17. The arm part 17 is provided at its end portion with a disengagement-preventing part 18 bent opposite to the attachment part 11 from the end portion at an angle with respect to the arm part 17.

Figure 4:
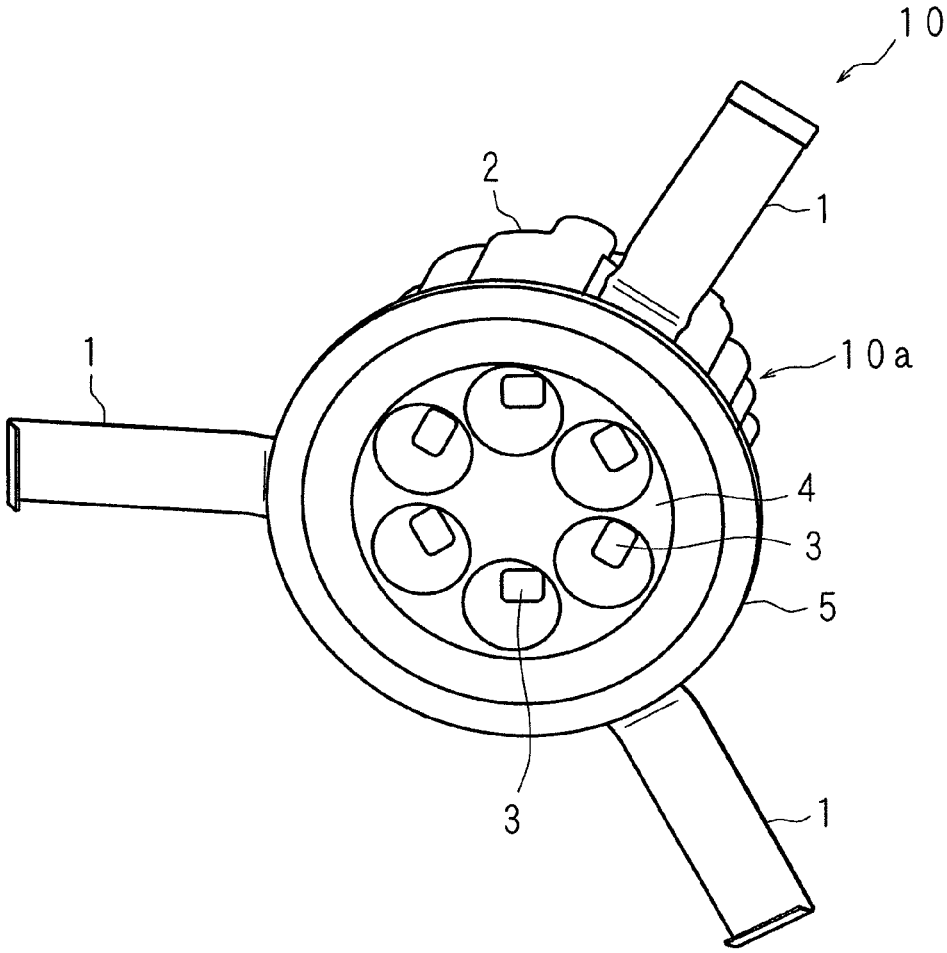
FIG. 4 is an external perspective view of a lighting apparatus including the leaf springs according to Embodiment 1.
Figure 5:
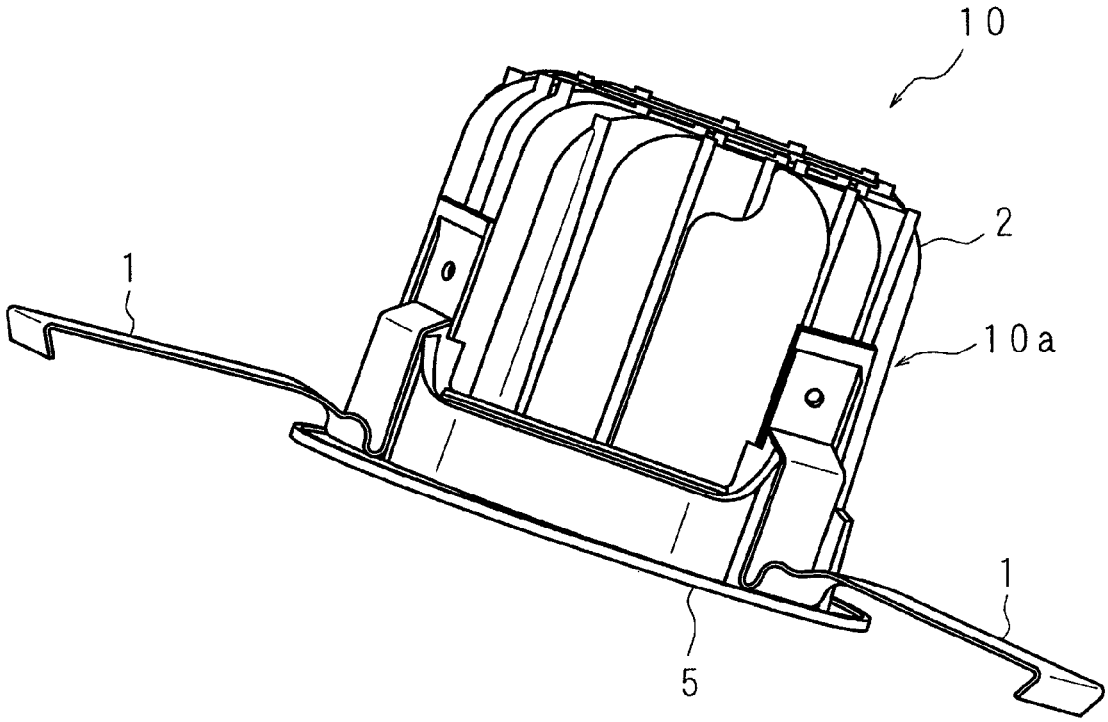
FIG. 5 is an external view of the lighting apparatus as viewed from its side.
Figure 6:
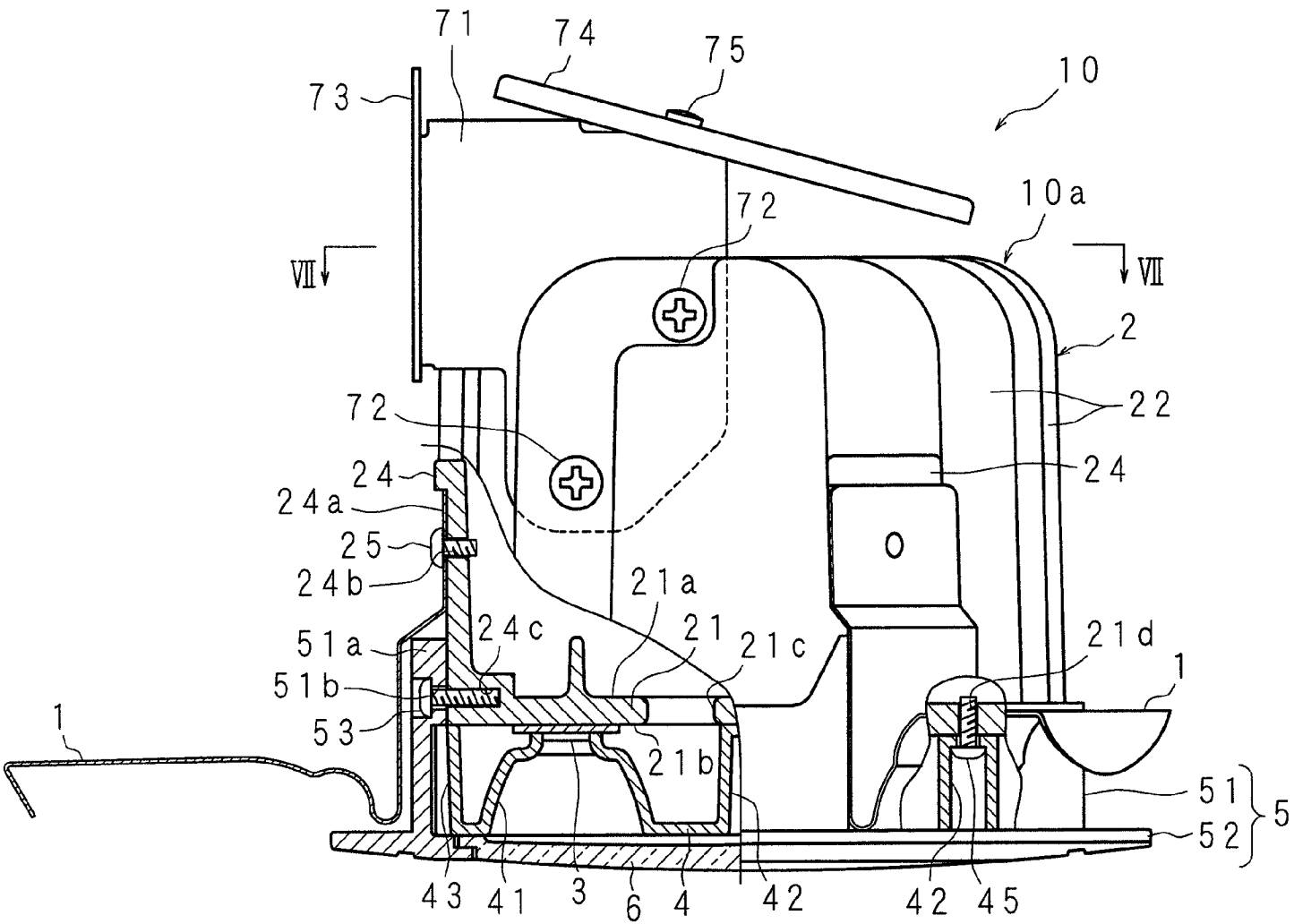
FIG. 6 is a schematic side view of the lighting apparatus.
Figure 7:
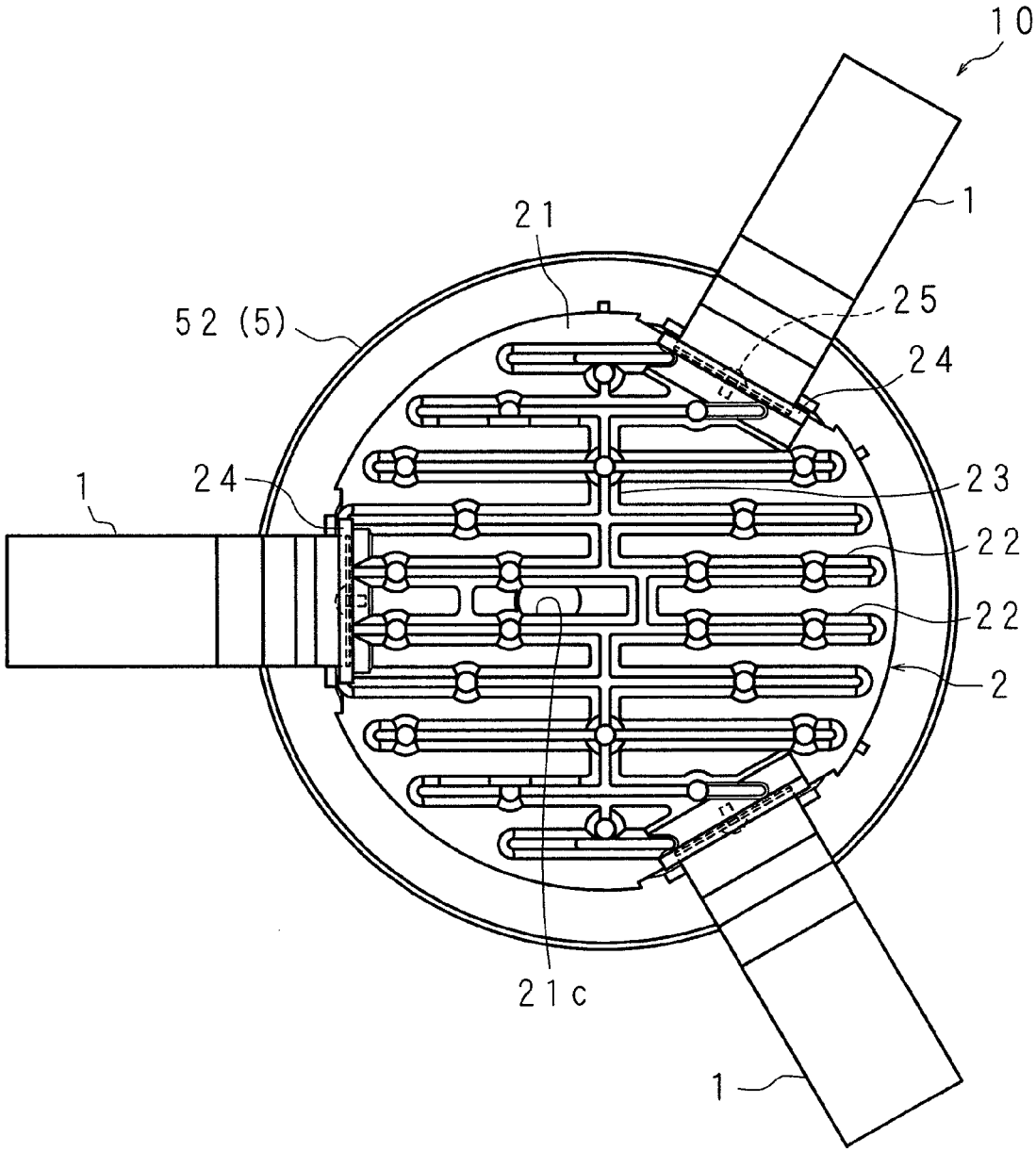
FIG. 7 is a schematic diagram of the lighting apparatus as viewed in a direction indicated by arrows of FIG. 6.

FIG. 4 is an external perspective view of a lighting apparatus 10 including the leaf springs 1 according to Embodiment 1. FIG. 5 is an external view of the lighting apparatus 10 as viewed from its side. FIG. 6 is a schematic side view of the lighting apparatus 10, illustrated partially in cross section. FIG. 7 is a schematic diagram of the lighting apparatus 10 as viewed in a direction indicated by arrows VII-VII of FIG. 6. Note that in FIG. 7, presentation of several components is omitted for the sake of convenience of description.

In each diagram, 10*a* represents a lighting apparatus main body. The lighting apparatus main body 10*a* includes a radiator 2 made of metal such as aluminum The radiator 2 has an approximately disk-like heat transfer plate 21. On one surface 21*a* of the heat transfer plate 21, a plurality of rectangular plate-like radiator plates 22, 22 . . . (ten radiator plates in the diagrams) are vertically provided in parallel. Further, on the one surface 21*a* of the heat transfer plate 21, a connection plate 23 is vertically provided so as to be passed through an approximate center of the plurality of radiator plates 22, 22 . . . and orthogonal to the plurality of radiator plates 22, 22 . . . . Note that as illustrated in FIG. 7, the connection plate 23 is formed so that a center portion of the heat transfer plate 21 is avoided, and the center portion of the heat transfer plate 21 is provided with a wiring through hole 21*c*. In the lighting apparatus in which a plurality of LED modules that will be described later are arranged along a circumferential direction of the heat transfer plate 21, wiring for the LED modules is facilitated by providing the wiring through hole 21*c* at the center portion of the heat transfer plate 21.

The heat transfer plate 21 is provided, at its center portion and peripheral edge portion, with a plurality of screw holes 21*d*, 21*d* . . . . At the peripheral edge portion of the heat transfer plate 21 of the radiator 2, rectangular plate-like attachment portions 24, 24 . . . are vertically provided at three circumferentially equidistant positions so as to be orthogonal to a radial direction of the heat transfer plate 21. The attachment portions 24, 24 . . . are formed continuously and integrally with a plurality of radiator plates 22, 22 . . . , and one of the attachment portions 24 is located so as to be continuous with the radiator plates 22, 22 . . . at right angles therewith. Outer surfaces 24*a*, 24*a* . . . of the attachment portions 24, 24 . . . are each formed into a flat surface, and upper and lower screw holes 24*b* and 24*c* are arranged at each attachment portion 24. Note that although the radiator 2 is molded in one piece by die casting in the present embodiment, the present invention is not limited to this method, but the radiator may be formed by extruding or cutting.

A plurality of LED modules 3, 3 . . . (six LED modules in the diagrams), serving as light sources, are circumferentially equidistantly attached to an other surface 21*b* of the heat transfer plate 21 of the radiator 2. The LED modules 3, 3 . . . each include: a rectangular ceramic (e.g., aluminum oxide) substrate; a plurality of (e.g., thirty-six) LED elements densely mounted on a center portion of one surface of the ceramic substrate; a sealing resin which seals the plurality of LED elements and in which a fluorescent material is dispersed; and input and output terminals. Note that a heat conduction seat or grease is preferably interposed between the LED modules 3, 3 . . . and the heat transfer plate 21. Heat generated by the LED modules 3, 3 . . . along with lighting of these LED modules 3, 3 . . . will be transmitted to the heat transfer plate 21, the radiator plates 22, 22 . . . and the connection plate 23 of the radiator 2, and will be dissipated to outside by natural convection.

At the other surface 21*b* of the heat transfer plate 21 of the radiator 2, a reflecting plate 4 is provided. At positions of the reflecting plate 4, which correspond to the LED modules 3, 3 . . . upon attachment of the reflecting plate 4 to the radiator 2, a plurality of reflecting parts 41, 41 . . . each having an approximately semi-spherical concave part are formed so as to surround the LED modules 3, 3 . . . . The reflecting plate 4 is formed by metal such as stainless steel, metal to which a high reflectance coating is applied, or a microcellular foam light reflecting material (e.g., MCPET [registered trademark]) having optical properties such as a high total reflectance (about 98%) and a high diffuse reflectance (about 95%).

At positions corresponding to the screw holes 21*d*, 21*d* . . . provided in the heat transfer plate 21 when the reflecting plate 4 is attached to the radiator 2, the reflecting plate 4 is provided with fixation portions 42, 42 . . . each having an approximately columnar concave part. Further, at a peripheral edge of the reflecting plate 4, a peripheral wall 43 is vertically provided. An end face of the peripheral wall 43 is abutted against the heat transfer plate 21, and screws 45, 45 . . . are inserted into through holes provided in the fixation portions 42, 42 . . . of the reflecting plate 4 and are screwed into the screw holes 21*d*, 21*d* . . . provided in the heat transfer plate 21, thus fixing the reflecting plate 4 to the radiator 2. Light emitted from the LED modules 3, 3 . . . is reflected by the reflecting parts 41, 41 . . . of the reflecting plate 4, and an angle thereof formed with respect to an optical axis of each of the LED modules 3, 3 . . . will fall within the range equal to or lower than a given angle. As a result, the lighting apparatus will emit light whose light distribution characteristic is controlled so that illuminance directly below lighting equipment is increased.

The radiator 2 is connected, at its region adjacent to the heat transfer plate 21, to a frame 5. The frame 5 includes: a cylinder 51; and an annular flange part 52 radially extended from one end of the cylinder 51 in a direction orthogonal thereto. The cylinder 51 is provided with extended portions 51*a*, 51*a* . . . extended opposite to the flange part 52 from three circumferential positions. The extended portions 51*a*, 51*a* . . . are provided with through holes 51*b*, 51*b* . . . . Note that the through holes 51*b*, 51*b* . . . are provided at positions corresponding to the screw holes 24*c*, 24*c* . . . , provided in the attachment portions 24, 24 . . . of the radiator 2, when the frame 5 is attached to the radiator 2. With the reflecting plate 4 internally fitted to the other end side of the cylinder 51 and the extended portions 51*a*, 51*a* . . . abutted against the outer surfaces 24*a*, 24*a* . . . of the attachment portions 24, 24 . . . of the radiator 2, screws 53, 53 . . . are inserted into the through holes 51*b*, 51*b* . . . and screwed into the screw holes 24*c*, 24*c* . . . , thus fixing the frame 5 to the radiator 2. A disk-like resin cover 6 is attached to an inner surface of the flange part 52 of the frame 5 so as to cover the LED modules 3, 3 . . . . The cover 6 is made of a polycarbonate resin, for example.

In the lighting apparatus main body 10*a* formed as described above, screws 25, 25 . . . are inserted into the through holes 11*a*, 11*a* . . . provided in the attachment parts 11, 11 . . . of the leaf springs 1, 1 . . . , and are screwed into the screw holes 24*b*, 24*b* . . . provided in the attachment portions 24, 24 . . . of the radiator 2; thus, with the attachment parts 11, 11 . . . of the leaf springs 1, 1 . . . brought into intimate contact with the outer surfaces 24*a*, 24*a* . . . of the attachment portions 24, 24 . . . , a plurality of leaf springs 1, 1 . . . according to Embodiment 1 are fixed to the radiator 2 at three circumferentially equidistant positions. As mentioned above, the attachment portions 24, 24 . . . are formed continuously and integrally with a plurality of radiator plates 22, 22 . . . , and thus have high rigidity; therefore, a load caused by self weight of the lighting apparatus main body 10*a* will act directly on the leaf springs 1, 1 . . . via the attachment portions 24, 24 . . . . Furthermore, since each metallic leaf spring 1 is directly attached to the radiator 2, the leaf spring 1 itself also functions as a radiator member, thereby enabling more effective heat radiation.

Note that in the present embodiment, thicknesses and shapes of the leaf springs 1, 1 . . . are decided so that the resultant of urging forces of the three leaf springs 1, 1 . . . , produced in response to elastic deformation thereof, becomes equal to or greater than a load which is six times as large as the self weight of the lighting apparatus main body 10*a*. Furthermore, in the present embodiment, in order to satisfy the foregoing load condition and to avoid dissimilar metal contact corrosion caused by aluminum serving as a material of the radiator 2, stainless steel (e.g., SUS304) is used for the leaf spring 1. Note that the disengagement-preventing part 18 is provided in order to prevent the lighting apparatus 10 from falling in a state in which the first pressing part 14 and the second pressing part 16 of the leaf spring 1 are not abutted against the ceiling.

Attachment plates 71, 71 are fixed via screws 72, 72 . . . to the second outermost radiator plates 22, 22 of the radiator 2 in parallel with the respective radiator plates 22, 22. A support plate 73, through which the attachment plates 71, 71 are connected to each other, is attached to one side of the attachment plates 71, 71. Further, a disk 74 is attached to upper parts of the attachment plates 71, 71, with the disk inclined obliquely downward. By means of the disk 74, foreign matter such as dust can be prevented from entering the lighting apparatus main body 10*a* between the radiator plates 22, 22 . . . in particular; in addition, when an upper part of the lighting apparatus main body 10*a* is covered with a heat insulator, it is possible to ensure an air duct through which air heated by heat transmission from surfaces of the radiator plates 22, 22 . . . and the connection plate 23 of the radiator 2 flows to outside. Hence, degradation in heat radiation characteristic, caused by entrance of foreign matter such as dust, can be prevented. Moreover, the support plate 73 is provided with a power supply part (not illustrated) including various circuit components such as a transformer, a resistor and a capacitor. Note that the LED modules 3, 3 . . . are connected to the power supply part via a lead wire (not illustrated) inserted into the through hole 21*c* provided at the center portion of the heat transfer plate 21.

The lighting apparatus 10 is fixed via the leaf springs 1, 1 . . . to an attachment hole provided in a ceiling, with the cover 6 located downward, and is thus used as a so-called "downlight". The lighting apparatus 10 is inserted into the ceiling attachment hole having a diameter of 125 mm and installed on the ceiling so that a spacing between the lighting apparatus main body 10*a* and the peripheral face of the attachment hole becomes about 10 mm FIG. 8 is a partially enlarged cross-sectional view illustrating a state in which the lighting apparatus 10 is installed on a ceiling having a thickness of 9 mm.

Figure 8:
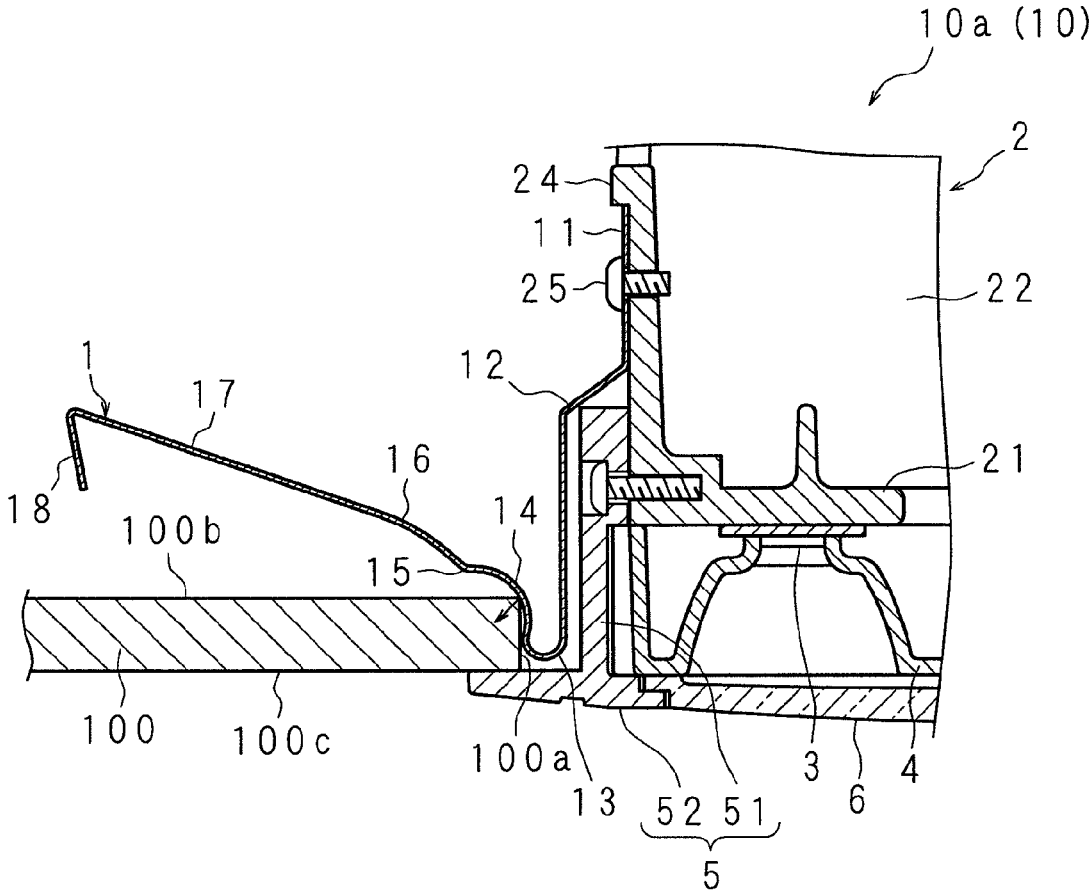
FIG. 8 is a partially enlarged cross-sectional view illustrating a state in which the lighting apparatus is installed on a ceiling having a thickness of 9 mm.

With the arm parts 17, 17 . . . of the leaf springs 1, 1 . . . pressed toward the lighting apparatus main body 10*a*, the lighting apparatus 10 is inserted from below into an attachment hole 100*a* provided in a ceiling 100, and a hand is released from the leaf springs 1, 1 . . . to further push the lighting apparatus main body 10*a* into the attachment hole 100*a*, thereby fixing the lighting apparatus 10 to the attachment hole 100*a* of the ceiling 100 as illustrated in FIG. 8. More specifically, when the leaf spring 1, elastically deformed by being pressed toward the lighting apparatus main body 10*a* upon installation into the attachment hole 100*a*, will return to its natural state indicated in FIG. 6 in response to the release of the pressing force, the first pressing part 14 of the leaf spring 1 abuts against an upper edge region of the attachment hole 100*a* from obliquely above in the vicinity of an approximate center of an arc thereof; then, as indicated by the arrow in FIG. 8, a force is exerted on the ceiling 100 at its abutment plane in a direction orthogonal to the abutment plane, i.e., in an obliquely downward direction with reference to the diagram, and a counteracting force is exerted on the first pressing part 14 in an obliquely upward direction with reference to the diagram due to an action-reaction relationship. Thus, a downward component of force is exerted on the installation plane of the ceiling 100, serving as the fit part, in a direction perpendicular thereto, and an upper surface 100*b* of the ceiling 100 is pressed downward by the first pressing part 14; in addition, an upward component of force is exerted on the lighting apparatus main body 10*a*, and a lower surface 100*c* of the ceiling 100 is pressed upward by an upper surface of the flange part 52 of the frame 5. As a result, the lighting apparatus 10 is fixed to the ceiling 100, with the ceiling 100 sandwiched between the first pressing part 14 and the flange part 52 serving as a part abutted against the ceiling 100.

As described above, since a pressing force including a sufficient downward component of force is exerted on the ceiling 100, the lighting apparatus 10 can be held on the ceiling 100. Furthermore, when a downward force is exerted on the lighting apparatus 10 and this force is thereafter released, a pressing force including a downward component of force is exerted on the upper surface 100*b* of the ceiling 100 by the urging force produced in response to the elastic deformation of the leaf spring 1, and therefore, the lighting apparatus 10 is allowed to return to its original position.

Figure 9:
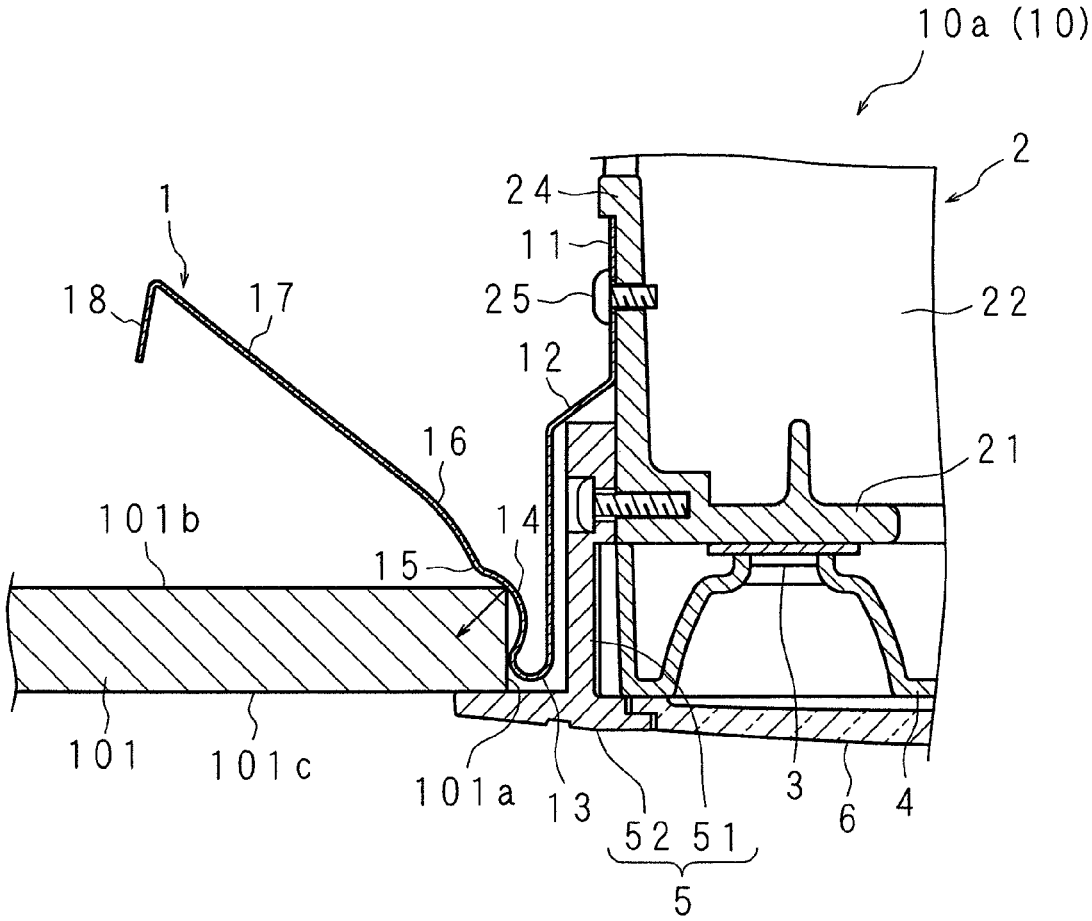
FIG. 9 is a partially enlarged cross-sectional view illustrating a state in which the lighting apparatus is installed on a ceiling having a thickness of 12 mm.

FIG. 9 is a partially enlarged cross-sectional view illustrating a state in which the lighting apparatus 10 is installed on a ceiling having a thickness of 12 mm. With the arm parts 17, 17 . . . of the leaf springs 1, 1 . . . pressed toward the lighting apparatus main body 10*a*, the lighting apparatus 10 is inserted from below into an attachment hole 101*a* provided in a ceiling 101, and a hand is released from the leaf springs 1, 1 . . . to further push the lighting apparatus main body 10*a* into the attachment hole 101*a*, thereby fixing the lighting apparatus 10 to the ceiling 101 via the attachment hole 101*a* as illustrated in FIG. 9. In FIG. 9, the first pressing part 14 of the leaf spring 1 is abutted against an upper edge region of the attachment hole 101*a* from obliquely above at a position closer to the convex part 15 than to a center of an arc of the first pressing part 14. Thus, as indicated by the arrow in FIG. 9, a force is exerted on the ceiling 101 in a direction orthogonal to its abutment plane, i.e., in an obliquely downward direction with reference to the diagram. Since an amount of deflection that causes elastic deformation of the leaf spring 1 is increased in response to an increase in the ceiling thickness, an urging force produced in response to the elastic deformation of the leaf spring 1 is increased in accordance with the increase in the ceiling thickness; thus, as compared with the case where the lighting apparatus is installed on the ceiling 100 having a thickness of 9 mm, the urging force exerted on the ceiling 101 having a thickness of 12 mm is increased, which will exert a pressing force including a sufficient downward component of force on an installation plane of the ceiling 101, serving as the fit part, in a direction perpendicular thereto.

As described above, similarly to the case where the lighting apparatus is installed on the ceiling 100 having a thickness of 9 mm, a pressing force including a sufficient downward component of force is exerted on the ceiling 101 having a thickness of 12 mm, and therefore, the lighting apparatus 10 can be held on the ceiling 101. Furthermore, also when a downward force is exerted on the lighting apparatus 10 and this force is thereafter released, a pressing force including a downward component of force is similarly exerted on an upper surface 101*b* of the ceiling 101 by the urging force produced in response to the elastic deformation of the leaf spring 1, and therefore, the lighting apparatus 10 is allowed to return to its original position.

Figure 10:
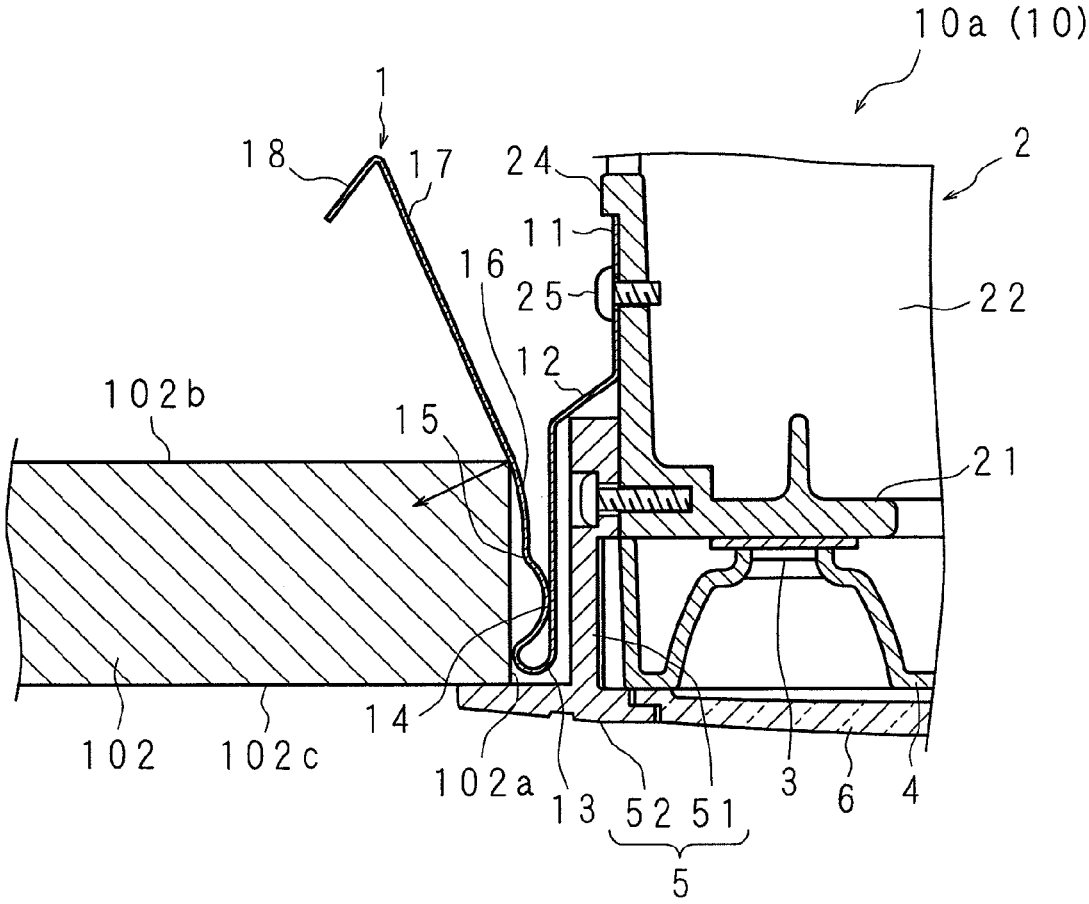
FIG. 10 is a partially enlarged cross-sectional view illustrating a state in which the lighting apparatus is installed on a ceiling having a thickness of 25 mm.

FIG. 10 is a partially enlarged cross-sectional view illustrating a state in which the lighting apparatus 10 is installed on a ceiling having a thickness of 25 mm. With the arm parts 17, 17 . . . of the leaf springs 1, 1 . . . pressed toward the lighting apparatus main body 10*a*, the lighting apparatus 10 is inserted from below into an attachment hole 102*a* provided in a ceiling 102, and a hand is released from the leaf springs 1, 1 . . . to further push the lighting apparatus main body 10*a* into the attachment hole 102*a*, thereby fixing the lighting apparatus 10 to the ceiling 102 via the attachment hole 102*a* as illustrated in FIG. 10. In FIG. 10, the second pressing part 16 of the leaf spring 1 is abutted against an upper edge region of the attachment hole 102*a* from obliquely above at a position closer to the arm part 17 than to a center of an arc of the second pressing part 16. Thus, as indicated by the arrow in FIG. 10, a force is exerted on the ceiling 102 in a direction orthogonal to its abutment plane, i.e., in an obliquely downward direction with reference to the diagram. Since an amount of deflection that causes elastic deformation of the leaf spring 1 is increased in response to an increase in the ceiling thickness, an urging force produced in response to the elastic deformation of the leaf spring 1 is increased in accordance with the increase in the ceiling thickness; thus, as compared with the case where the lighting apparatus is installed on the ceiling 100 having a thickness of 9 mm, the urging force exerted on the ceiling 102 having a thickness of 25 mm is further increased. Furthermore, the convex part 15 is spaced apart from a peripheral face of the attachment hole 102*a* of the ceiling 102, and the urging force produced in response to the elastic deformation of the leaf spring 1 is exerted on the ceiling 102 by the second pressing part 16 only, which will thus exert a sufficient pressing force including a downward component of force on an installation plane of the ceiling 102, serving as the fit part, in a direction perpendicular thereto.

As described above, a pressing force including a sufficient downward component of force is exerted on the ceiling 102 having a thickness of 25 mm, and therefore, the lighting apparatus 10 can be held on the ceiling 102. Furthermore, also when a downward force is exerted on the lighting apparatus 10 and this force is thereafter released, a pressing force including a downward component of force is similarly exerted on an upper surface 102*b* of the ceiling 102 by the urging force produced in response to the elastic deformation of the leaf spring 1, and therefore, the lighting apparatus 10 is allowed to return to its original position.

As stated above, the V-shaped leaf spring 1 is provided at its one side with the attachment part 11 to be attached to the lighting apparatus main body 10*a*, and is provided at its other side with a plurality of pressing parts, i.e., the first pressing part 14 and the second pressing part 16 which are curved convexly toward the attachment part 11 and arc-shaped in cross-section along the longitudinal direction of the leaf spring 1. In such a structure, when the lighting apparatus main body 10*a* is installed into an attachment hole of a ceiling, either the first pressing part 14 or the second pressing part 16 will be abutted against an upper edge region of the attachment hole from above for a ceiling having different thicknesses. As a result, a sufficient downward pressing force can be exerted on the ceiling having different thicknesses, and the lighting apparatus 10 can be fixed to the ceiling with a sufficient holding force.

The first pressing part 14 and the second pressing part 16 of the leaf spring 1 are curved with radii of curvature increased/reduced in accordance with distances thereof from the bent part 13. In such a structure, the first pressing part 14 with a small radius of curvature will be abutted against the ceiling 100 or 101 having a small thickness, and the second pressing part 16 with a large radius of curvature will be abutted against the ceiling 102 having a large thickness. As a result, as mentioned above, an angle formed between the pressing part and ceiling can be appropriately maintained so that the pressing part abuts against the ceiling from obliquely above, thereby making it possible to exert a sufficient downward pressing force on the ceiling having different thicknesses.

The convex part 15, curved opposite to the first pressing part 14 and the second pressing part 16, is provided between the first pressing part 14 and the second pressing part 16 of the leaf spring 1. In such a structure, as compared with a case where the pressing parts are provided in a continuous manner, an angle formed between one side and other side of the leaf spring 1 can be reduced. As a result, when the lighting apparatus 10 is installed into an attachment hole of a ceiling, it is unnecessary to apply a large force to the leaf spring 1 in order to bring the one side and other side of the leaf spring 1 close to each other, thus facilitating an attachment operation. Further, the convex part 15 is provided in the leaf spring 1 so as to be spaced apart from a peripheral face of an attachment hole of a ceiling when the lighting apparatus 10 is installed into the ceiling; therefore, an urging force produced in response to elastic deformation of the leaf spring 1 can be exerted on the ceiling by the pressing part only, and a pressing force including a sufficient downward component of force can be exerted on the ceiling.

Note that although the three leaf springs 1, 1 . . . are attached to the lighting apparatus main body 10*a* in the present embodiment, the present invention is not limited to this. The number of the leaf springs is appropriately selected in accordance with weight and size of the lighting apparatus main body 10*a* to be held.

Moreover, the power supply part is provided outside the lighting apparatus main body 10*a* in the present embodiment, but the power supply part may naturally be provided inside the lighting apparatus main body 10*a*.

Embodiment 2

Figure 11:
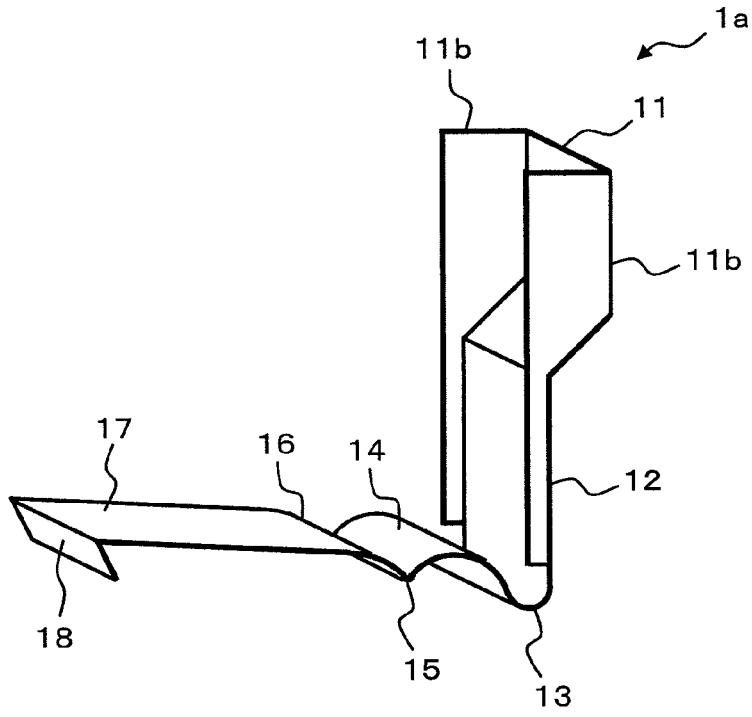
FIG. 11 is an external perspective view of a leaf spring according to Embodiment 2.

FIG. 11 is an external perspective view of a leaf spring according to Embodiment 2. At edge portions of an attachment part 11 and an extended part 12 of a leaf spring 1*a*, reinforcing plates 11*b*, 11*b*, extended toward a first pressing part 14 and a second pressing part 16 in a direction orthogonal to the attachment part 11 and the extended part 12, are provided along substantially the entire longitudinal lengths of the attachment part 11 and the extended part 12. Note that the reinforcing plates 11*b*, 11*b* may be formed by being worked into a single piece continuous with the attachment part 11 and the extended part 12 and being folded back, or may be formed separately therefrom and attached thereto. Since other structures are similar to those of Embodiment 1 illustrated in FIG. 1, corresponding constituent elements are identified by the same reference characters as those used in FIG. 1, and detailed description thereof will be omitted.

The rigidity of the attachment part 11 and the extended part 12 can be increased by providing the reinforcing plates 11*b*, 11*b* at the edge portions of the attachment part 11 and the extended part 12 as described above. As a result, upon pushing of the arm part 17 of the leaf spring 1*a* toward the lighting apparatus main body when a lighting apparatus is installed on a ceiling, it becomes difficult for the attachment part 11 and the extended part 12 to be elastically deformed, which facilitates an operation for installation of the lighting apparatus 10 on the ceiling. Further, the leaf spring 1*a* is tightly attached via a screw to the radiator 2 through which heat from heat sources such the LED modules 3, 3 . . . is dissipated, and a heat radiation area of the radiator 2 is substantially increased by areas of the reinforcing plates 11*b*, 11*b*, thus enabling an improvement in the heat radiation characteristic of the lighting apparatus 10.

Embodiment 3

Figure 12:
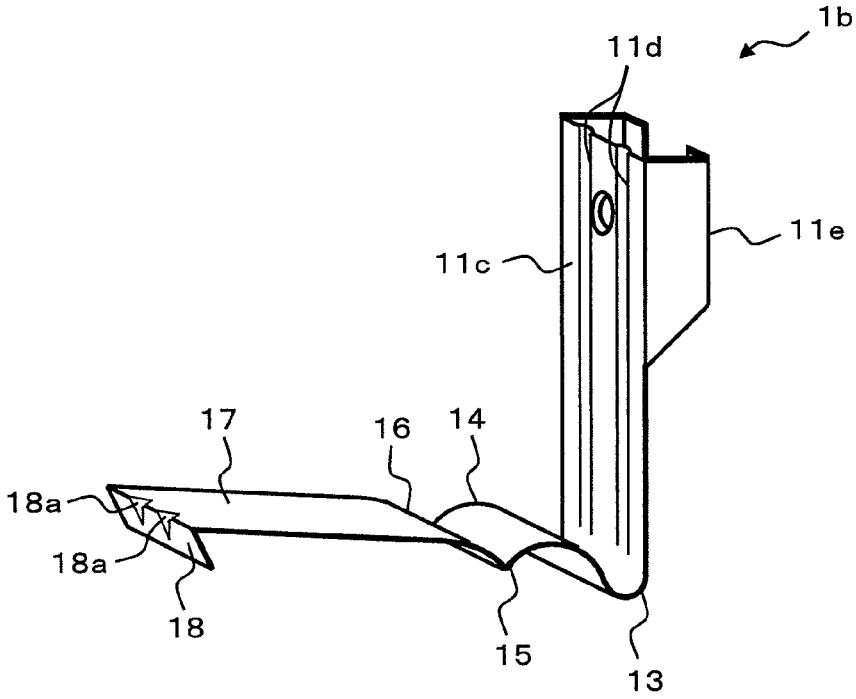
FIG. 12 is an external perspective view of a leaf spring according to Embodiment 3.

FIG. 12 is an external perspective view of a leaf spring according to Embodiment 3. A leaf spring 1*b* is provided at its one end with a rectangular plate-like attachment part 11*c*. At the attachment part 11*c*, concave parts 11*d*, 11*d* are provided along a longitudinal direction of the attachment part 11*c* so as to be spaced apart at an appropriate distance. Furthermore, the attachment part 11*c* is provided at its edge portions with reinforcing plates 11*e*, 11*e* that are extended opposite to a first pressing part 14 and a second pressing part 16 in a direction orthogonal to the attachment part 11*c*, and are folded back from extended end portions in a direction in which the reinforcing plates 11*e*, 11*e* are brought close to each other. Moreover, at a connection between an arm part 17 and a disengagement-preventing part 18, concave parts 18*a*, 18*a* are provided so as to be spaced apart at an appropriate distance. Since other structures are similar to those of Embodiment 1 illustrated in FIG. 1, corresponding constituent elements are identified by the same reference characters as those used in FIG. 1, and detailed description thereof will be omitted.

The rigidity of the attachment part 11*c* can be increased by providing the concave parts 11*d*, 11*d* and the reinforcing plates 11*e*, 11*e* at the attachment part 11*c* as described above. As a result, upon pushing of the arm part 17 of the leaf spring 1*b* toward the lighting apparatus main body when a lighting apparatus is installed on a ceiling, it becomes difficult for the attachment part 11*c* to be elastically deformed, which facilitates an operation for installation of the lighting apparatus 10 on the ceiling. The connection between the arm part 17 and the disengagement-preventing part 18 is provided with the concave parts 18*a*, 18*a*, thus making it possible to increase the rigidity of the connection. As a result, it is possible to facilitate support of a load of the lighting apparatus main body 10*a* applied to the disengagement-preventing part 18 when the lighting apparatus 10 is moved downward in a state in which the first pressing part 14 and the second pressing part 16 of the leaf spring 1*b* are not abutted against the ceiling. Besides, the reinforcing plates 11*e* function as a spacer for providing no bent part in the attachment part 11*c*. The attachment part is formed into such a shape, thereby facilitating formation of the concave parts 11*d*.

Embodiment 4

Figure 13A:
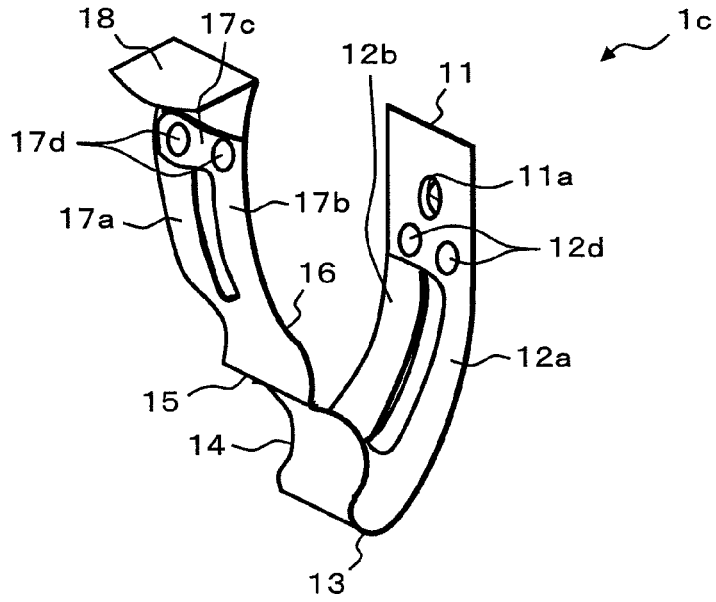
FIG. 13A is an external perspective view of a leaf spring according to Embodiment 4.
Figure 13B:
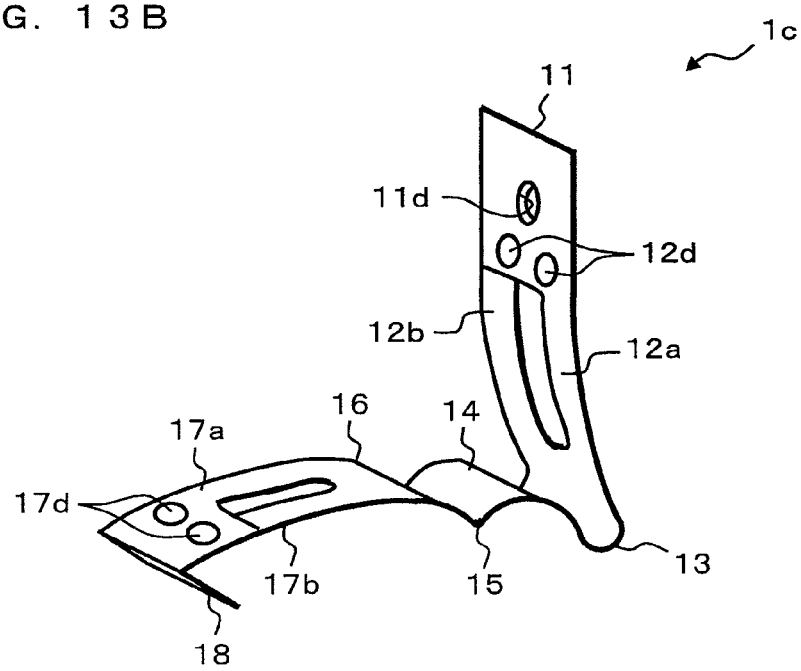
FIG. 13B is an external perspective view of the leaf spring according to Embodiment 4.
Figure 14A:
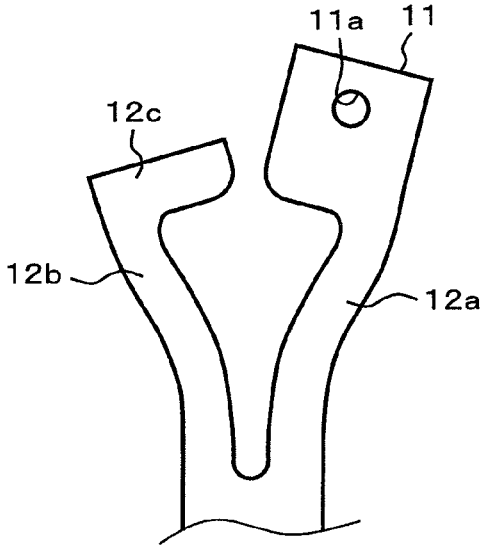
FIG. 14A is an explanatory diagram illustrating fabrication of a Belleville spring part.
Figure 14B:
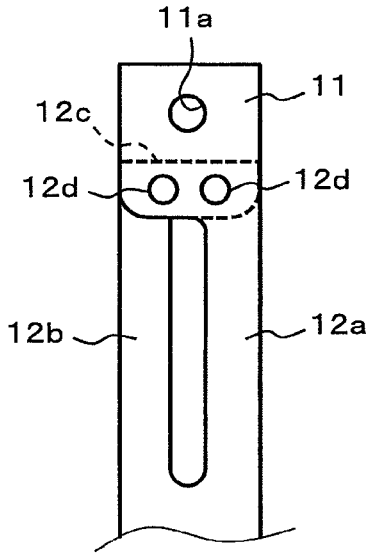
FIG. 14B is an explanatory diagram illustrating fabrication of the Belleville spring part.

FIG. 13A and FIG. 13B are external perspective views of a leaf spring according to Embodiment 4. FIG. 13A illustrates a state of the leaf spring at the time of packaging, and FIG. 13B illustrates a state of the leaf spring when a lighting apparatus is installed on a ceiling. An extended part extended from one end of a leaf spring 1*c* is formed by connecting two curved arm parts 12*a* and 12*b* with each other, thus providing a so-called "Belleville spring" structure. FIG. 14A and FIG. 14B are explanatory diagrams illustrating fabrication of a Belleville spring part. As illustrated in FIG. 14A, a stainless steel plate is worked into a Y shape. The aim part 12*a* connected to an attachment part 11 and convexly curved toward the other arm part 12*b*, and the arm part 12*b* curved in a direction opposite to the curved direction of the arm part 12*a* are brought close to each other so that an extended part 12*c*, extended toward the arm part 12*a* from a tip of the arm part 12*b*, is overlapped with a region of the arm part 12*a* of the attachment part 11, and the arm parts are fixed to each other via spot welding 12*d*, 12*d* as illustrated in FIG. 14B. Note that a fixation method is not limited to spot welding, but the arm parts may be fastened to each other by a rivet.

Similarly, arm parts connected to a second pressing part 16 also have a so-called "Belleville spring" structure, in which the two curved arm parts 17*a* and 17*b* are connected to each other via spot welding 17*d*, 17*d* at an extended part 17*c* extended from one of the arm parts, i.e., the arm part 17*b*. Since other structures are similar to those of Embodiment 1 illustrated in FIG. 1, corresponding constituent elements are identified by the same reference characters as those used in FIG. 1, and detailed description thereof will be omitted.

At the time of packaging of the leaf spring 1*c* formed as described above, a force is applied in a direction in which one side and other side of the leaf spring 1*c* are brought close to each other, and the arm parts 12*a* and 12*b* and the arm parts 17*a* and 17*b* are curved convexly outward as illustrated in FIG. 13A; thus, the leaf spring 1*c* can be compact in size, and packaging is facilitated, thereby enabling enhancement of packaging operation efficiency. Note that at the time of installation, a force is applied in a direction in which the one side and other side of the leaf spring 1*c* go away from each other, thus allowing the leaf spring 1*c* to easily return to a V shape as illustrated in FIG. 13B.

Figure 15:
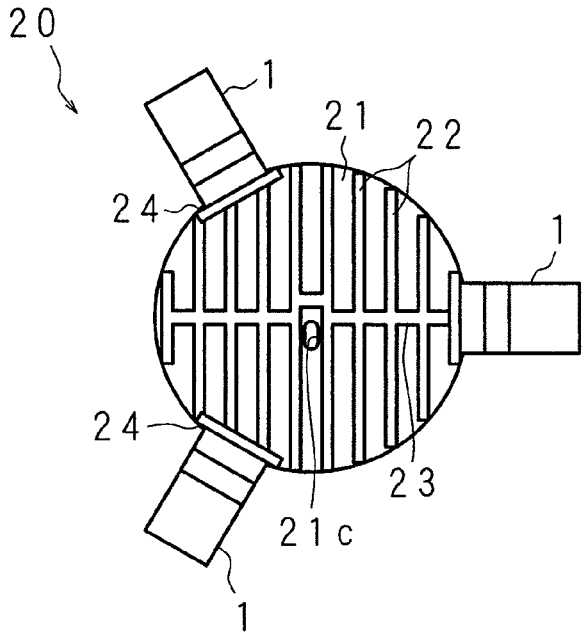
FIG. 15 illustrates another arrangement example of the leaf springs.

Similarly to the leaf spring 1 according to Embodiment 1, the leaf springs according to Embodiments 2 to 4 described above are attached to the lighting apparatus main body 10*a* so as to be arranged as illustrated in FIG. 7. Note that the arrangement of the leaf springs is not limited to the arrangement illustrated in FIG. 7. FIG. 15 illustrates another arrangement example of the leaf springs.

The attachment portions 24, 24 . . . are formed continuously and integrally with a plurality of radiator plates 22, 22 . . . . The attachment portions 24, 24 . . . are vertically provided at the heat transfer plate 21 at three circumferentially equidistant positions so that the outward radiator plate 22 also functions as one of the plurality of attachment portions 24. In such a structure, impediments to the flow of air coming into the radiator 2 can be further removed while the rigidity of the attachment portions 24, 24 . . . is maintained at a high level, and an improvement in the heat radiation characteristic is enabled.

Note that in the foregoing embodiments, based on the assumption that the thickness of a ceiling on which a lighting apparatus is to be installed would fall within the two ranges, i.e., the range of 6 mm to 9 mm and the range of 20 mm to 25 mm, the radius of curvature R1 of the first pressing part 14 is set at 6 mm, and the radius of curvature R2 of the second pressing part 16 is set at 23 mm; however, these radii of curvature R1 and R2 are provided by way of example, and the present invention is not limited to these numerical values. The radii of curvature R1 and R2 of the first pressing part 14 and the second pressing part 16 are decided in accordance with the thickness of a ceiling, on which a lighting apparatus is assumed to be installed, so that only either the first pressing part 14 or the second pressing part 16 is abutted against the ceiling from above, and are appropriately set in accordance with the ceiling thickness, the distance between the lighting apparatus main body and peripheral face of an attachment hole, the weight of the lighting apparatus main body, the number of the leaf springs, etc.

Further, although each leaf spring is provided with two pressing parts consisting of the first pressing part 14 and the second pressing part 16 in the foregoing embodiments, the present invention is not limited to this, but each leaf spring may be provided with three or more pressing parts.

Furthermore, although the leaf spring has been illustrated and described as the fitting member in each of the foregoing embodiments, the fitting member is not limited to a plate-like shape, but may be a fitting member having a plurality of pressing parts and having a linear urging force. For example, the fitting member may be formed by bending a metal wire.

Moreover, although the LED modules 3, 3 . . . , implemented as light sources by a plurality of LED elements, are used in the foregoing embodiments, the present invention is not limited to this, but a high-intensity LED chip, EL (Electro Luminescence), a fluorescent lamp, an electric bulb, etc., may be used.

Besides, although an example in which the leaf spring is attached to a downlight has been described in each of the foregoing embodiments, the application of the present invention is not limited to a downlight, but the leaf springs according to the present invention are also applicable to other types of lighting apparatuses and to apparatuses to be installed on ceilings other than lighting apparatuses; in addition, the present invention may naturally be implemented in variously modified forms within the scope defined by the claims.

The invention claimed is:

1. A fitting member used to fit a lighting apparatus to one fit part of a plurality of fit parts, the fit parts having different thicknesses, the fitting member comprising:

a plurality of pressing parts adapting to the thickness of the fit part and formed of a continuous member, wherein each pressing part is arc-shaped.

2. The fitting member according to claim 1, wherein one of the pressing parts is pressed to the fit part by a force including a force perpendicular thereto.

3. The fitting member according to claim 1, wherein the fitting member is a leaf spring.

4. A lighting apparatus, comprising:

a lighting apparatus main body fitted by the fitting member according to claim 1.

5. The lighting apparatus according to claim 4, further comprising:

a heat radiation part dissipating heat;

wherein the fitting member is located at a position that does not impede a flow of air coming into the heat radiation part.

6. The lighting apparatus according to claim 4, wherein the lighting apparatus is fitted to the fit part by sandwiching the fit part between the fitting member and a part of the lighting apparatus abutted against the fit part.

7. A fitting member used to fit a lighting apparatus to one fit part of a plurality of fit parts, the fit parts having different thicknesses, the fitting member comprising:

a plurality of pressing parts adapting to the thickness of the fit part and formed of a continuous member, wherein the plurality of pressing parts are curved with different radii of curvature.

8. The fitting member according to claim 7, further comprising:

a bent part;

wherein one of the plurality of pressing parts, located further away from the bent part, has a larger radius of curvature.

9. The fitting member according to claim 7, wherein one of the pressing parts is pressed to the fit part by a force including a force perpendicular thereto.

10. The fitting member according to claim 7, wherein the fitting member is a leaf spring.

11. A fitting member used to fit a lighting apparatus to one fit part of a plurality of fit parts, the fit parts having different thicknesses, the fitting member comprising:

a plurality of pressing parts adapting to the thickness of the fit part and formed of a continuous member, wherein a connection between successive two of the plurality of pressing parts is located on a side of the pressing part from a straight line formed between two final end portions of the plurality of continuously provided pressing parts.

12. A lighting apparatus, comprising:

a lighting apparatus main body fitted by the fitting member according to claim 7.

13. The lighting apparatus according to claim 12, wherein the lighting apparatus is fitted to the fit part by sandwiching the fit part between the fitting member and a part of the lighting apparatus abutted against the fit part.

14. The fitting member according to claim 11, wherein the fitting member is a leaf spring.

15. The fitting member according to claim 11, wherein one of the pressing parts is pressed to the fit part by a force including a force perpendicular thereto.

16. The lighting apparatus according to claim 12, further comprising:

a heat radiation part dissipating heat;

wherein the fitting member is located at a position that does not impede a flow of air coming into the heat radiation part.

17. A lighting apparatus, comprising:

a lighting apparatus main body fitted by the fitting member according to claim 11.

18. The lighting apparatus according to claim 17, further comprising:

a heat radiation part dissipating heat;

wherein the fitting member is located at a position that does not impede a flow of air coming into the heat radiation part.

19. The lighting apparatus according to claim 17, wherein the lighting apparatus is fitted to the fit part by sandwiching the fit part between the fitting member and a part of the lighting apparatus abutted against the fit part.

20. A leaf spring, wherein the leaf-spring is V-shaped, and the leaf spring comprises:

a plurality of pressing parts provided at one side of the leaf spring, curved convexly toward the other side of the leaf spring, arc-shaped in cross section along a longitudinal direction of the leaf spring and formed of a continuous member.

21. A lighting apparatus, comprising:

a lighting apparatus main body to be installed into an attachment hole opened in a ceiling; and a V-shaped leaf spring to be interposed between the lighting apparatus main body and the attachment hole with a region of the leaf spring at a bent part thereof located downward, including a plurality of pressing parts, adapting to the ceiling having different thicknesses, at one side thereof, and attached at the other side thereof to the lighting apparatus main body;

wherein the lighting apparatus main body is fixed to the ceiling by an urging force produced in response to elastic deformation of the leaf spring; and upon installation of the lighting apparatus main body into the attachment hole, any one of the plurality of pressing parts abuts against an upper edge region of the attachment hole from above.

22. A lighting apparatus, comprising:

a lighting apparatus main body to be installed into an attachment hole opened in a ceiling; and a V-shaped leaf spring to be interposed between the lighting apparatus main body and the attachment hole with a region of the leaf spring at a bent part thereof located downward, including a plurality of pressing parts provided at one side thereof, curved convexly toward the other side thereof, and arc-shaped in cross section along a longitudinal direction, and attached at the other side thereof to the lighting apparatus main body;

wherein the lighting apparatus main body is fixed to the ceiling by an urging force produced in response to elastic deformation of the leaf spring; and upon installation of the lighting apparatus main body into the attachment hole, any one of the plurality of pressing parts abuts against an upper edge region of the attachment hole from above.

* * * * *